US011197585B1

(12) United States Patent
Podemska-Mikluch et al.

(10) Patent No.: US 11,197,585 B1
(45) Date of Patent: Dec. 14, 2021

(54) PORTABLE CHILD SINK

(71) Applicants: Marta Podemska-Mikluch, Belle Plaine, MN (US); Lukasz Andrzej Mikluch, Belle Plaine, MN (US)

(72) Inventors: Marta Podemska-Mikluch, Belle Plaine, MN (US); Lukasz Andrzej Mikluch, Belle Plaine, MN (US)

( * ) Notice: Subject to any disclaimer, the term of this patent is extended or adjusted under 35 U.S.C. 154(b) by 0 days.

(21) Appl. No.: 16/819,962

(22) Filed: Mar. 16, 2020

Related U.S. Application Data

(60) Provisional application No. 62/823,766, filed on Mar. 26, 2019.

(51) Int. Cl.
*A47K 1/02* (2006.01)
*A47K 1/12* (2006.01)
*A47K 1/04* (2006.01)

(52) U.S. Cl.
CPC ..... *A47K 1/02* (2013.01); *A47K 1/04* (2013.01); *A47K 1/12* (2013.01)

(58) Field of Classification Search
CPC ... A47K 1/02; A47K 1/04; A47K 1/12; A47K 1/05; E03C 1/05; E03C 1/057
USPC ..... 4/625
See application file for complete search history.

(56) References Cited

U.S. PATENT DOCUMENTS 165,296 A * 7/1875 Bond ..... A47K 1/02 4/625
175,475 A * 3/1876 Wright ..... A47K 1/02 4/625
444,531 A * 1/1891 Greene ..... A47K 1/02 4/625
1,751,294 A 3/1930 Spital
3,289,664 A 12/1966 Hewitt
3,453,665 A * 7/1969 Hager ..... A47K 1/04 4/625
5,182,822 A 2/1993 Cyr et al.
5,301,376 A 4/1994 Herbert
5,502,848 A 4/1996 Cowan
5,704,078 A 1/1998 Chandler
D409,732 S 5/1999 Maddux et al.
(Continued)

FOREIGN PATENT DOCUMENTS

WO WO2008092229 A1 8/2008

OTHER PUBLICATIONS

"Monsam Toddler Single Basin Portable Sink: 25" PSE-2006," Monsam Portable Sinks, https://www.portablehandwashing.com/Monsam-Child-s-Height-Single-Basin-Portabie-Sink-p/pse-2006.htm, Jun. 2, 2017, Web.

(Continued)

*Primary Examiner* — Benjamin R Shaw
(74) *Attorney, Agent, or Firm* — Mai-Tram D. Lauer; Westman, Champlin & Koehler, P.A.

(57) ABSTRACT

An apparatus includes a base; a reservoir connected to the base and configured to hold a fluid; a first vessel having a first volume and configured to be removably connected to the base; a connection configured to deliver the fluid from the reservoir to at least the first vessel; and a second vessel. The second vessel is configured to be disposed at least partially within the first vessel; configured to be removably secured to the first vessel; includes an aperture that allows for fluid communication between the second vessel and the first vessel; and has a second volume that is less than the first volume.

20 Claims, 8 Drawing Sheets

(56) References Cited

U.S. PATENT DOCUMENTS

| | | | | |
|---|---|---|---|---|
| 5,915,417 | A | 6/1999 | Diaz et al. | |
| 6,161,228 | A * | 12/2000 | Wietecha | A47K 1/02 4/625 |
| 6,253,394 | B1 * | 7/2001 | Goyette | A47K 1/02 4/626 |
| 6,959,460 | B2 | 11/2005 | Patterson | |
| 7,490,375 | B2 | 2/2009 | Luk | |
| 7,802,327 | B1 | 9/2010 | Moceri et al. | |
| 8,925,124 | B2 | 1/2015 | Littlehorn, Sr. | |
| 2004/0148697 | A1 * | 8/2004 | Patterson | A47K 1/02 4/619 |
| 2007/0056091 | A1 | 3/2007 | Bolton et al. | |
| 2007/0199146 | A1 * | 8/2007 | Kostelyk | E03B 11/02 4/625 |
| 2010/0051639 | A1 | 3/2010 | Stob et al. | |
| 2011/0296605 | A1 | 12/2011 | Kerr | |
| 2012/0233769 | A1 * | 9/2012 | Song | A61C 17/14 4/625 |
| 2013/0019908 | A1 * | 1/2013 | St-Pierre | B08B 3/006 134/105 |
| 2015/0083748 | A1 * | 3/2015 | McHale | E03C 1/046 222/52 |

OTHER PUBLICATIONS

"Infant/Toddler Single Basin Portable Sink 20"," All Safety Products, https://www.allsafetyproducts.com/infant-toddler-single-basin-portable-sink.html, obtained Jun. 2, 2017, Web.

"Jonti-Craft Birch Clean Hands Helper Portable Sink Child Height", PortableSinks4Less.com, https://www.portablesinks4less.com/portable-sinks/jonti-craft-birch-cien-hands-helper-child-height/, dated 2016, obtained Jun. 2, 2017, Web.

"Ozark River Lil Premier Portable Sink—Hot Water Child Height, Single ABS Basin," PortableSinks4Less.com, https://www.portablesinks4less.com/portable-sinks/ozark-river-lil-premier-portable-sink/, dated 2016, obtained Jun. 2, 2017, Web.

"Fisher-Price Sink Set #918," This Old Toy's Fisher Price featured Toy, http://www.thisoldtoy.com/L_FP_Set/toy-pages/900-999/918-fisherpricesinkset.html, dated 1998-1999, obtained June 2, 2017, Web.

"Little Tikes Splish Splash Sink and Stove" Instruction Manual, Item No. 635557M, undated, obtained from https://www.littletikes.com/mas_assets/media/pdf/635557M%20Little%20Tikes%20Splish%20Splash%20Sink%20N%20Stove.pdf on Mar. 16, 2020, Web.

* cited by examiner

PORTABLE CHILD SINK

CROSS REFERENCE TO RELATED APPLICATIONS

This application claims the benefit of priority from U.S. Provisional Patent Application No. 62/823,766, filed Mar. 26, 2019, the content of which is hereby incorporated by reference in its entirety.

BACKGROUND

A portable child sink is described to offer toddlers a sink experience similar to what adults know and enjoy. It is sized and configured to allow toddlers to wash their hands and brush their teeth, thereby instilling healthy habits. Such an apparatus is a perfect educational gift for a baby's first birthday.

There already exist small tubs and mini toilets. While other child sinks are known, they often include drawbacks, such as a requirement for plumbing hook-ups to a building's water supply pipes. Such designs are therefore unsuitable for locations where such plumbing access is inconvenient or unavailable. Moreover, such design requirements increase cost and decrease flexibility in placement and mobility. Accordingly, there is a need for a child sink that is simple to set up and use, as well as easy to move to different locations.

SUMMARY

In one aspect, an apparatus includes a base; a reservoir connected to the base and configured to hold a fluid; a first vessel having a first volume and configured to be removably connected to the base; a connection configured to deliver the fluid from the reservoir to at least the first vessel; and a second vessel. The second vessel is configured to be disposed at least partially within the first vessel; configured to be removably secured to the first vessel; includes an aperture that allows for fluid communication between the second vessel and the first vessel; and has a second volume that is less than the first volume.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. It is contemplated that all descriptions are applicable to like and analogous structures throughout the several embodiments.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

DETAILED DESCRIPTION

Figure 1:
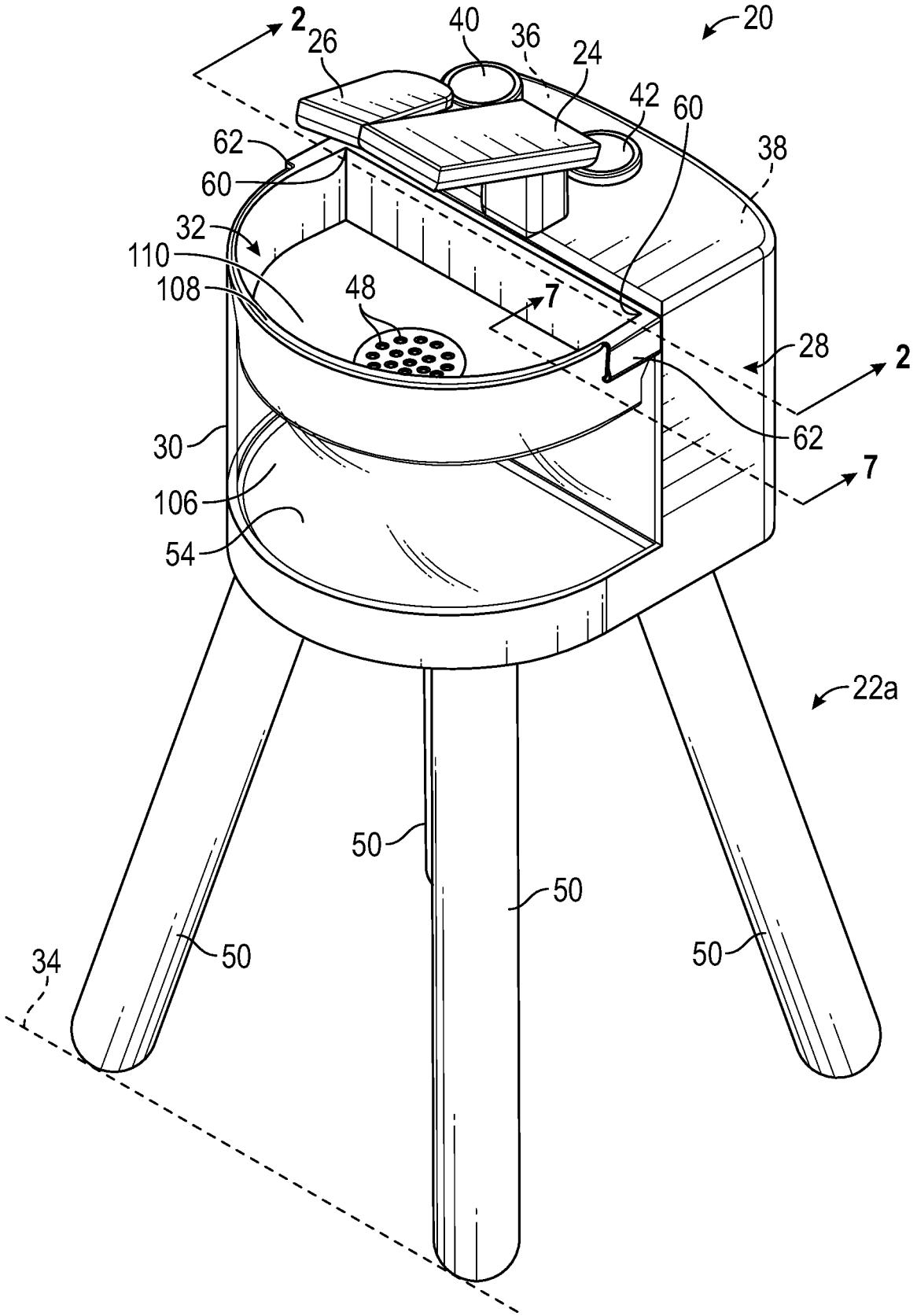
FIG. 1 is a perspective view of an exemplary sink with an optional leg assembly.
Figure 2:
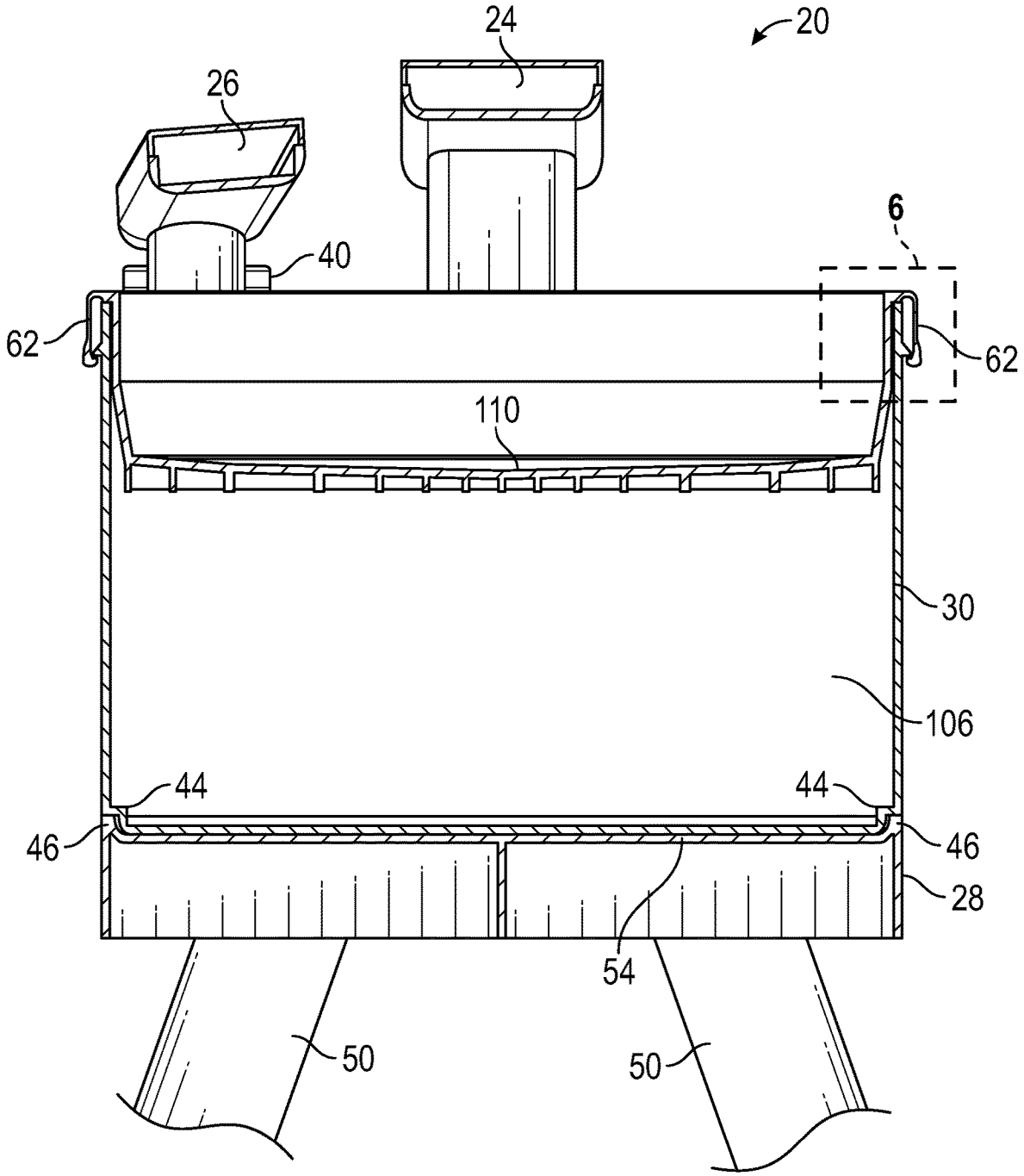
FIG. 2 is a cross-sectional view of the exemplary sink, taken along line 2-2 of FIG. 1.
Figure 3:
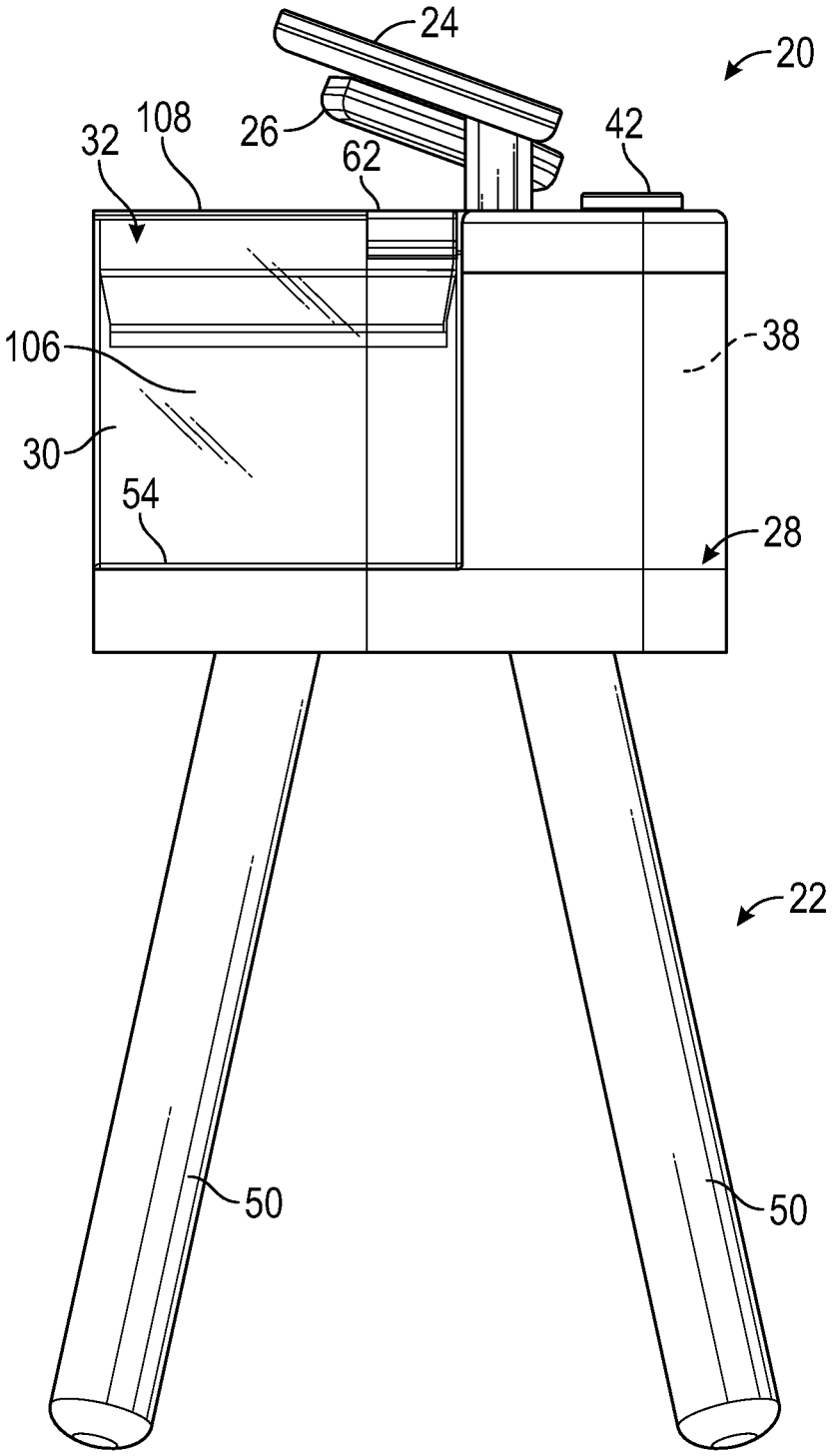
FIG. 3 is a side elevation view of the exemplary sink.

FIG. 1 is a perspective view of an exemplary portable child sink 20 with an optional leg assembly. FIG. 2 is a partial cross-sectional view, taken along line 2-2 of FIG. 1. FIG. 3 is a side elevation view of the exemplary sink. Sink 20 is light and portable. Because there is no required plumbing or electrical hook-up, sink 20 can be placed at any location around the house or even outside. Bathrooms are an obvious location, but it can also be placed in a child's bedroom, kitchen, mudroom, or other location, such as daycare centers and in-home daycares.

Sink 20 is a perfect addition to potty-training, but it can also be used much earlier in a child's development, as soon as she or he learns to stand unsupported. Starting so early ensures that children form a habit of washing hands after coming home, before meals, and at other appropriate times. In an exemplary embodiment, faucet 24 and soap dispenser 26 are motion-activated to facilitate ease of use for toddlers, versus traditional handles and levers that could be hard to reach and operate, and wasteful if left on by an inattentive child. Such motion-activated features can be battery-operated, thereby eliminating a need for an electrical outlet.

Figure 11:
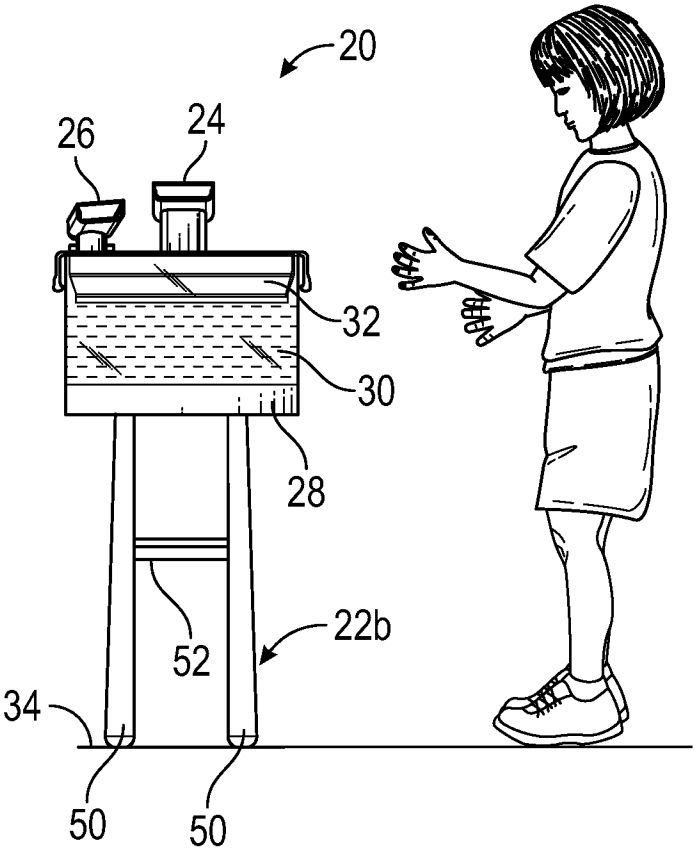
FIG. 11 is a front elevation view of an exemplary sink placed on an optional leg assembly to raise the sink above a floor surface, for use by a taller child.

In an exemplary embodiment, sink 20 includes faucet 24 and soap dispenser 26 on base 28, waste water container 30, upper tray 32. Accessories include a leg assembly 22 having legs 50. In an exemplary embodiment, different sets of leg assemblies 22 are provided to enable support of sink 20 at various heights above floor surface 34. For example, FIG. 1 shows relatively shorter leg assembly 22*a*, while FIG. 11 shows relatively longer leg assembly 22*b*.

Figure 4:
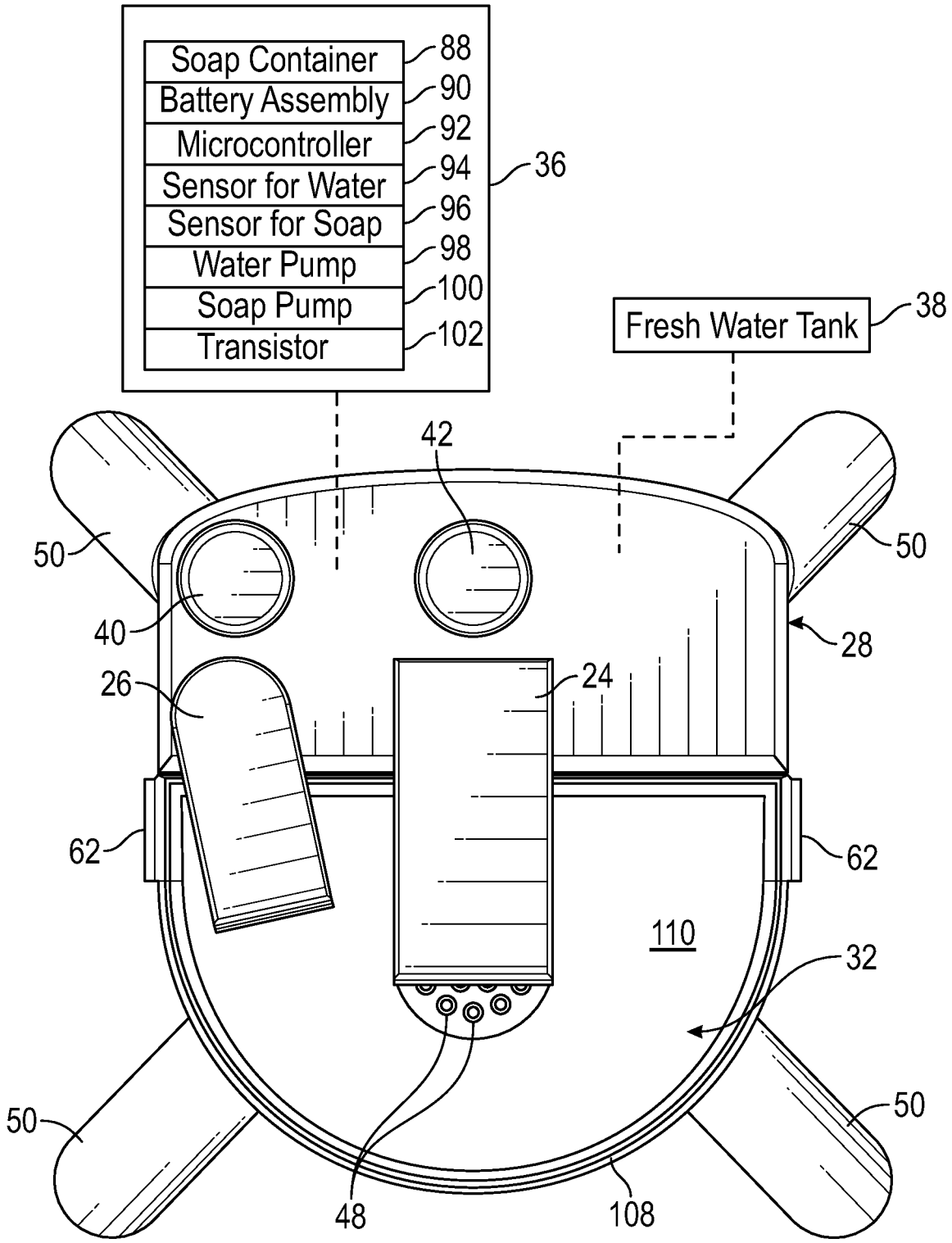
FIG. 4 is a top view of the exemplary sink.

FIG. 4 is a top view of the exemplary sink 20, also showing standard components that are internal to the housing 36 of base 28 in boxes. One portion of the base 28 includes an electronics and soap housing 36, which contains soap container 88, battery assembly 90, microcontroller 92, sensor 94 for water dispensing, sensor 96 for soap dispensing, water pump 98, soap pump 100, and transistors 102, among other electronic items and internal components. Base 28 also includes an internal fresh water tank 38.

To prepare sink 20 for use, several steps may be performed. For battery insertion and replacement in the electronics and soap housing 36, ensure that an On/Off switch (not labeled) is set to "Off" so that the motion/object sensors are powered off. Remove the battery compartment cover (not labeled) of battery assembly 90, insert or replace the batteries in the compartment, and replace the battery compartment cover.

Figure 5:
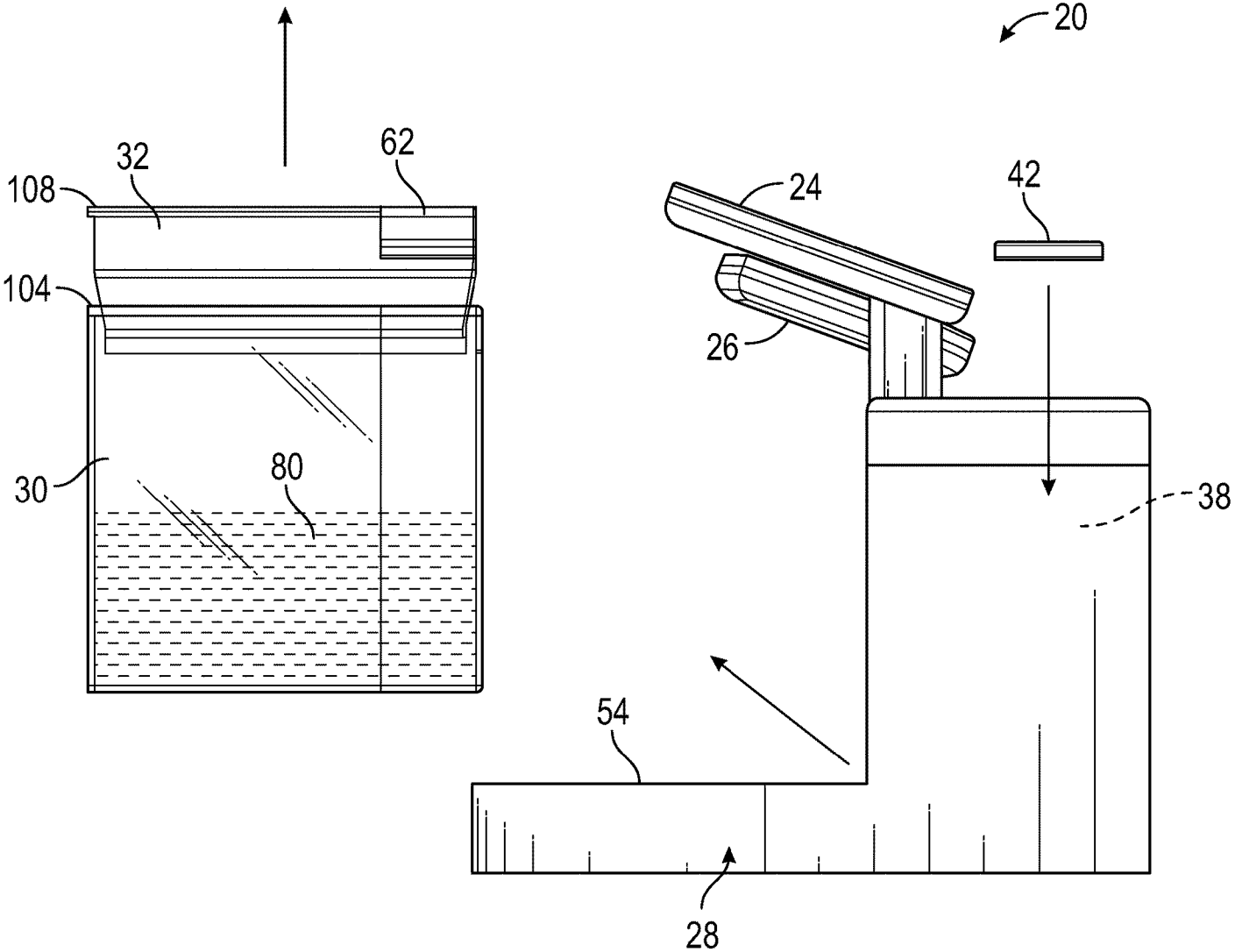
FIG. 5 is a side elevation exploded view of the exemplary sink.

As shown in FIG. 5, fresh water tank 38 includes a removable water tank plug 42. A user removes plug 42, such as by lifting it from a fill hole, to allow for the filling of fresh water tank 38. In an exemplary method of use, water container 30 is removed from base 28, emptied, cleaned, and filled with fresh water 80 by an adult at a plumbed faucet of a building or outdoor hose. The water 80 is poured from waste water container 30 and into the opening of fresh water tank 38 (with water tank plug 42 removed therefrom). In an exemplary embodiment, a volumetric capacity of fresh water tank 38 is about one liter, and a capacity of waste water container 30 is greater than the capacity fresh water tank 38. Accordingly, waste water container 30 would not overflow from use of sink 20, as an adult would empty waste water container 30 before refilling fresh water tank 38. In an exemplary embodiment, the waste water container 30 can include a marking to indicate a "fill line" for a volume that fills fresh water tank 38. In an exemplary embodiment, a soap container 88 accessible through an opened soap plug 40 is also fillable and refillable in a known manner.

An exemplary method of use includes inserting upper tray 32 into waste water container 30 so that an upper rim flange 108 of upper tray 32 rests upon an upper sidewall edge 104 of waste water container 32. In an exemplary embodiment, the upper tray 32 and waste water container 30 are secured together by cooperating clips 62 at the connecting upper rims of upper tray 32 and waste water container 30. Upper tray 32 has a smaller volumetric capacity than waste water container 30. Upper tray 32 has a plurality of drain holes 48, allowing water 80 to drain from upper tray 32 to waste water container 30. The components of sink 20 are sized so that much or all of the water from fresh water tank 38, after use via faucet 24, will drain through holes 48 and be retained in waste water container 30. This offers advantages over washing hands in a simple bowl, because the water 80 is drained away from the child's reach, thereby prevent spilling and splashing. The affirmative attachment between tray 32 and waste water container 30 ensures that the parts 30, 32 remain connected until an adult intends to disconnect them. While a clipping attachment is described between tray 32 and waste water container 30, it is contemplated that other attachments can be used, such as snap fit structures, for example.

For use, an adult flips the On/Off switch on housing portion 36 to "On" to enable motion/object sensors. Sensor 94 is provided for dispensing water, and sensor 96 is provided for dispensing soap. A child can dispense water or soap as appropriate by waving his or her hands near the faucet 24 (and water sensor 94) or soap dispenser 26 (and soap sensor 96). In an exemplary embodiment, components of sink 20 are sized to provide for several hand washings before adult attention is needed to empty the waste water container 30 and refill the fresh water tank 38.

The parts of sink 20 are easy to clean after mutually separating the upper tray 32, waste water container 30 and base 28, as shown in FIGS. 5-9. Empty any water in the waste water container 30 and the fresh water tank 38. Wash each of the upper tray 32 and waste water container 30 with a mixture of water and mild soap; dry with a dry cloth. Optionally, upper tray 32 and waste water container 30 may be cleaned in an automatic dishwasher. Because the electronics and soap housing 36 contains electrical components, it should not be immersed. Rather, base 28 can be cleaned by wiping surfaces with a damp, soft cloth or pre-moistened wipe. All parts should be allowed to dry.

In an exemplary embodiment, sink 20 is primarily composed of various types of plastics, along with other metallic and non-metallic content found with any commercial electric/electronic components used in this product. Polypropylene-type plastics are especially suitable, chosen for their strength, fatigue resistance, lack of toxicity, and reasonable temperature tolerance. Plugs 40 and 42 are suitably composed of a flexible nitrile rubber compound.

In an exemplary embodiment, waste water container 30 functions to collect and contain the used waste-water 80 after hand washing. In an exemplary embodiment, waste water container 30 is shaped like an open-ended half-cylinder, oriented with the open end accessible from above, and with the flat, rectangular edge of the half-cylinder facing the vertical wall of base 28. This shape presents a curved surface to the user, with no sharp corners facing the child. Although a semi-circular shape is exemplary, it is understood that waste water container 30 and a correspondingly shaped upper tray 32 can have other shapes, including a rounded cuboid, for example.

Figure 8:
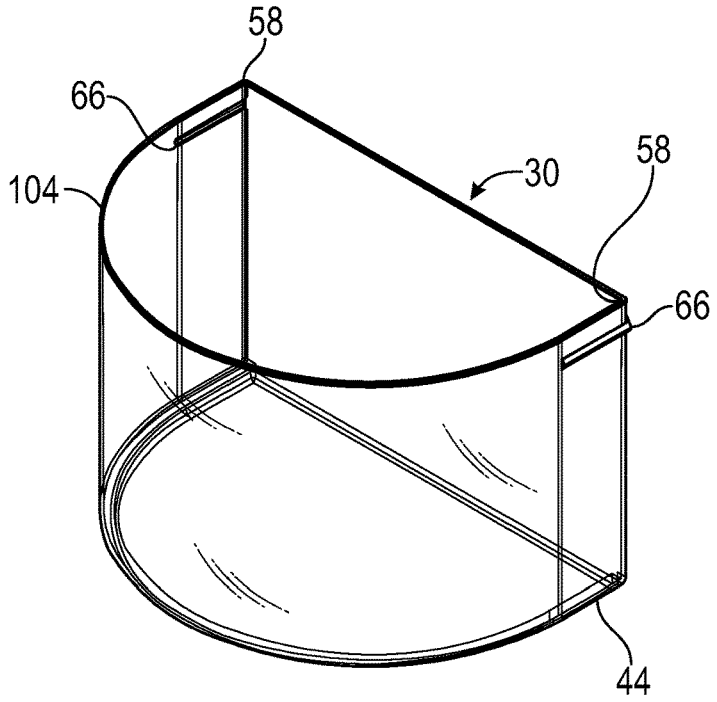
FIG. 8 is a perspective view of an exemplary waste water container.
Figure 9:
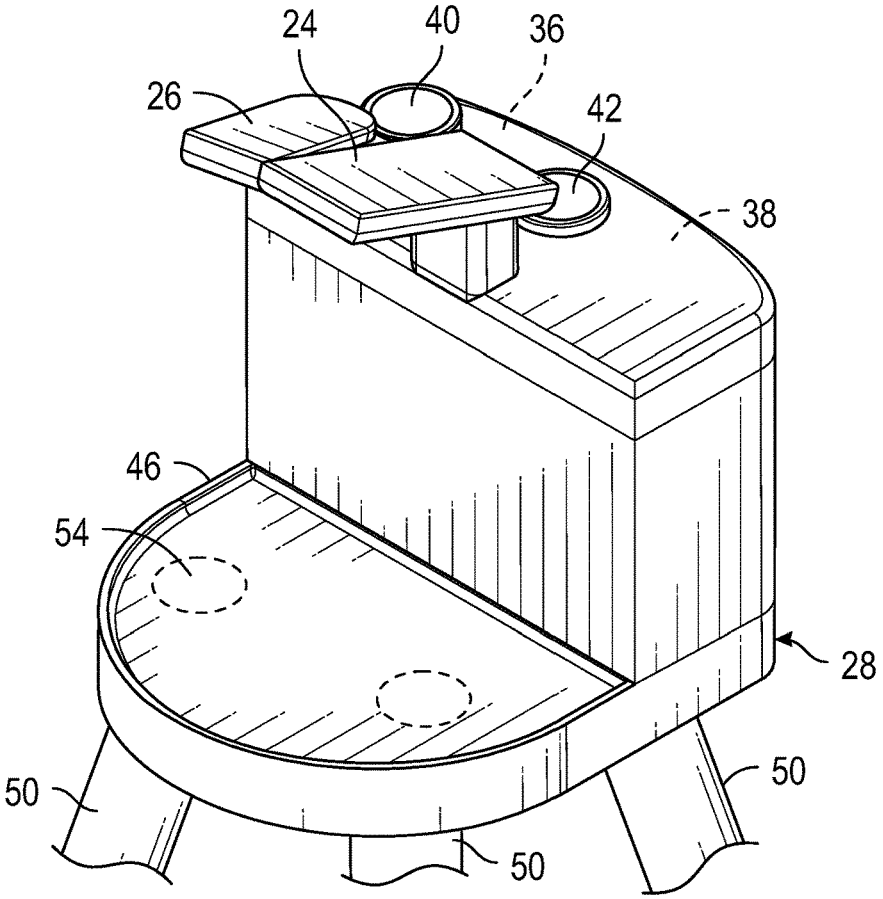
FIG. 9 is a perspective view of an exemplary base.

In an exemplary embodiment, the entire container 30 is transparent to easily allow a user to visually monitor its contents. Moreover, such visual transparency allows a user to easily determine a suitable filling volume when container 30 is used to provide water to fresh water tank 38. As shown in FIG. 8, corners 58 of container 30 may serve as convenient pouring spouts. In an exemplary embodiment, container 30 can hold nearly 2 liters of water (below the level of the floor of the removable upper tray 32), though it is recommended to empty and clean the container 30 when fresh water tank 38 needs refilling. As shown in FIGS. 2, 8, and 9, in an exemplary embodiment, the bottom perimeter edge of waste water container 30 includes stepped edge 44 to allow easy yet snug placement of the container 30 onto perimeter ridge 46 of container platform 24 of sink base 28. The depth of the step is approximately ¾" of an inch, providing additional stability and adherence of the waste water container 30 to the container platform 54 of the sink base 28. Thus, separation of the waste water container 30 from the sink base 28 occurs only when a user intentionally lifts the waste water container 30 upwards.

In an exemplary embodiment, upper tray 32 functions as a barrier between the contents of the waste water container 30 and the child, while allowing the running water from faucet 24 to exit the tray 32 through small holes 48 and drain into the waste water container 30. Upper tray 32 also functions to contain debris, thereby preventing larger objects, such as water toys or towels, from falling into the lower portion of waste water container 30. Because most of the used water drains from upper tray 32 and into a childinaccessible area 106 of waste water container 30, the configuration of sink 20 minimizes the chance of water splashing onto the floor surface 34 when a child washes his or hands. In an exemplary embodiment, a rate of water that flows through faucet 24 is less than a rate of water drainage from tray 32 through drain holes 48 to prevent pooling of standing water in upper tray 32.

In an exemplary embodiment, upper tray 32 is shaped like an open-ended half-cylinder, oriented with the open end accessible from above. It approximates the width and horizontal depth contours of the waste water container 30 minus a fractional amount, to allow the tray 32 to be inserted and fit into a top portion of the waste water container 30. In an exemplary embodiment, floor 110 of upper tray 32 dips downward toward drain holes 48. In an exemplary embodiment, the height of upper tray 32 is approximately half or less compared to the height of the waste water container 30. In an exemplary embodiment, the bottom of the tray 32 has symmetrically-spaced holes 48 arranged in a circular pattern near a center thereof. In an exemplary embodiment, the drain arrangement includes symmetrically spaced holes 48, each sized with a 0.25" diameter.

In an exemplary embodiment, tray 32 is affirmatively attached to waste water container 30 by clips 62. In an exemplary embodiment, clips 62 are positioned along the top perimeter of the tray 32 near the two corners 60. As shown in FIGS. 1, 2, 6 and 7, clips 62 protrude slightly outwards from the upper rim 108 of the upper tray 32. In an exemplary embodiment, clips 62 protrude outward and curve down over the upper sidewall edge 104 of the waste water container 30. Clip 62 includes a nub 64 configured to snap over a ridge 66 provided on an outside surface of waste water container 30. As shown in FIG. 2, the fit of the clip 62 relative to ridge 66 is tight, which allows the tray 32 to effectively snap and hold securely onto the waste water container 30. In an exemplary embodiment, each clip 62 is approximately 1" to 2.5" in length (measured horizontally along the rim of upper tray 32). The illustrated embodiments show two clips 62, though more or fewer may be used. Additionally, while a particular location and configuration of clips 62 is shown, it is understood that other placements and configurations can also be used.

As shown in FIGS. 2 and 6-8, in an exemplary embodiment, ridge 66 is positioned approximately 0.75" below upper sidewall edge 104 of container 30 and is configured as a horizontal protruding structure, approximately $1/16^{th}$ to $1/8^{th}$ of an inch thick in both protruding width and height, and approximately 1" to 2.5" in horizontal length. On both sides of sink 20, ridge 66 is centered and aligned with clip 62 for cooperating engagement. This ridge 66 provides resistance to any unwanted relative vertical movement between upper 32 tray and container 30. In an exemplary embodiment, ridge 66 has a trapezoidal cross-sectional shape with inclined face 56; outer face 68 meets horizontally extending bottom wall 72.

Figure 7:
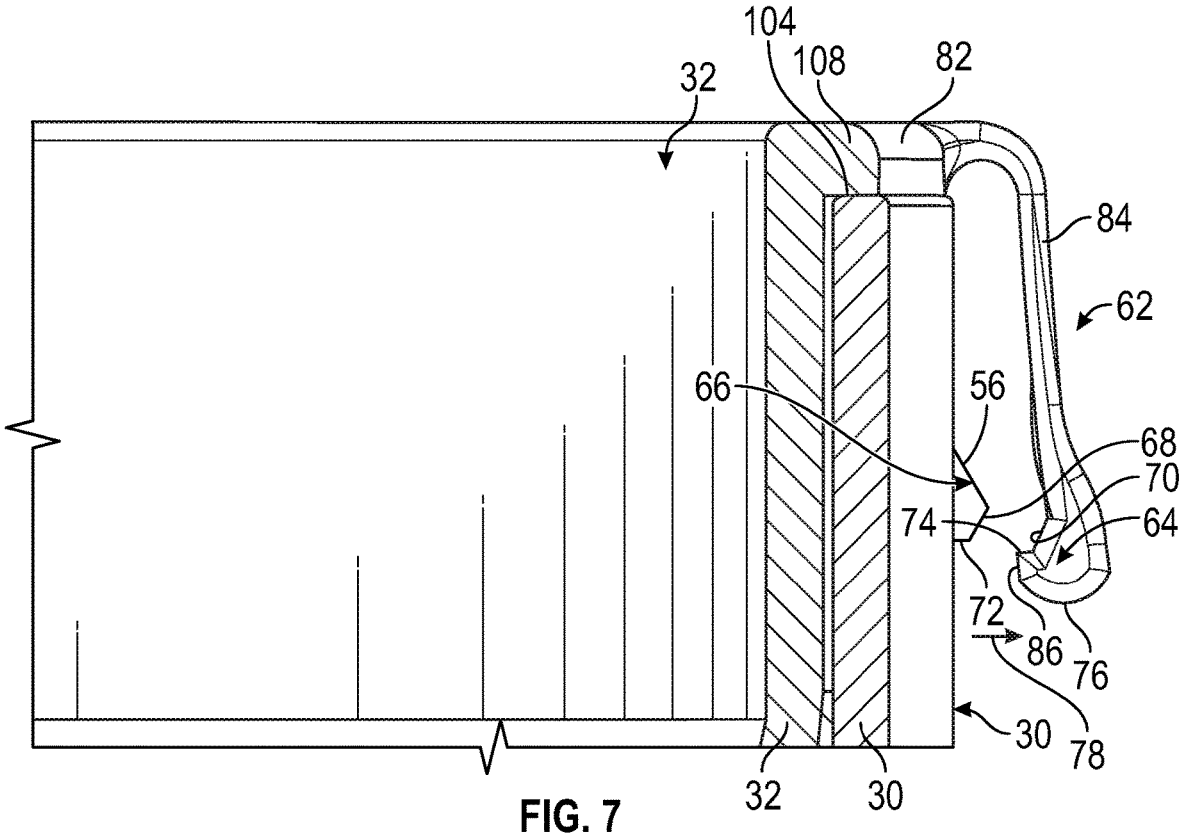
FIG. 7 is similar to FIG. 6, but taken at line 7-7 of FIG. 1, and shows the upper tray clip in a disengaged configuration relative to the waste water container.

In an exemplary embodiment, clip 62 includes a top wall 82, vertical wall 84, and nub 64 with end 86. In an exemplary embodiment, clip 62 has an inclined inner face 70 and a substantially horizontal top nub wall 74 that meets vertical nub end 86. Additionally, nub 64 has a rounded bottom nub wall 76 that connects an outer surface of vertical clip wall 84 and nub end 86. In an exemplary embodiment, the inclination of face 70 of clip 62 substantially matches the inclination of outer face 68 of ridge 66 to form a tight connection when attached as shown in FIG. 2. As shown in FIG. 7, in an exemplary embodiment, the rounded shape of bottom wall 76 of nub 64 assists a user in pulling nub 64 outward in direction 78 to flex clip 62 open, thereby allowing disengagement of clip 62 from ridge 66.

Figure 6:
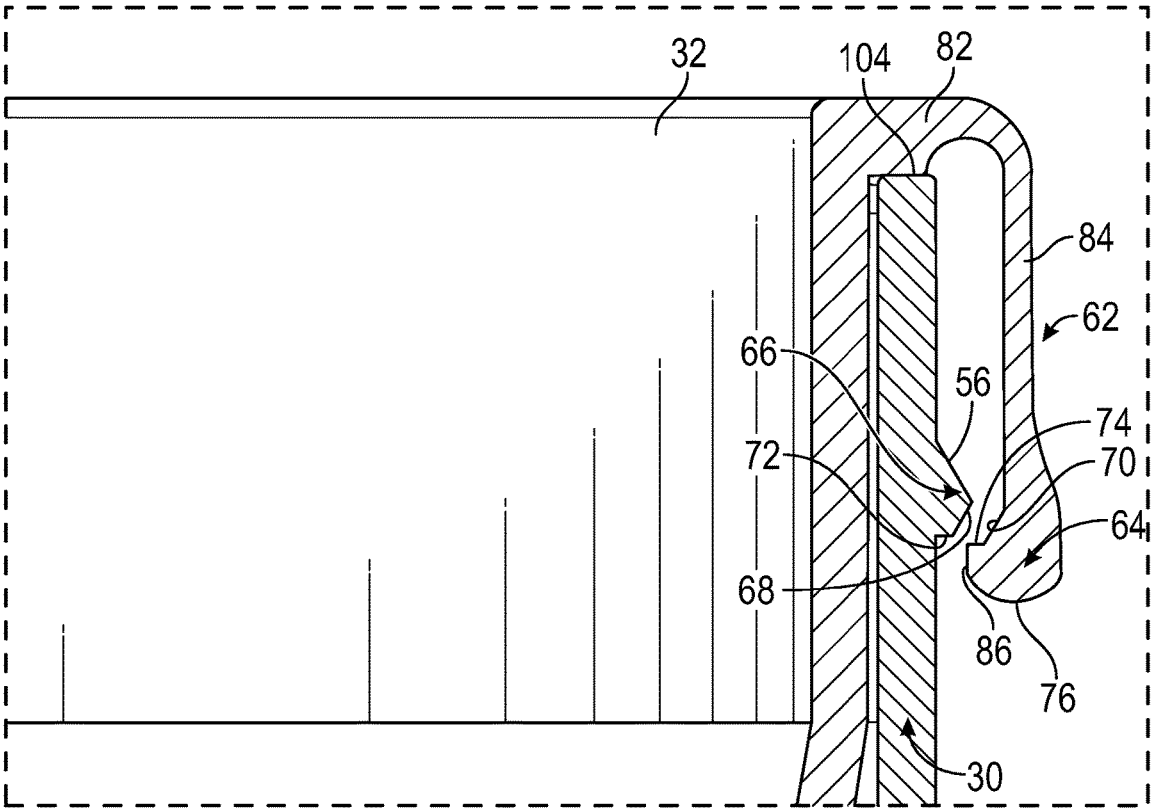
FIG. 6 is a partial cross-sectional view, taken at the dotted region labeled "6" of FIG. 2, of a clip being manipulated to allow for detachment of the upper tray from the waste water container.

In an exemplary embodiment, clips 62 are molded as an integral component of upper tray 32. In an exemplary embodiment, the materials and construction of clip 62 and ridge 66 are designed so that the required force is great enough that the upper tray 32 would not be separated from the waste water container 30 due to moderate inertial forces (e.g. shaking or agitating). However, the required force is not so great as to preclude the easy separation of the upper tray 32 from the waste water container 30 when doing so intentionally uses the proper technique, as illustrated in FIGS. 5-7.

For example, detaching the upper tray 32 from the waste water container 30 can be accomplished by grasping the clips 62 with fingers so that the fingertips contact the bottom wall 76 of the clips. The user applies a relatively light force to flex clips 62 outward in direction 78. Re-inserting the upper tray 32 onto the waste water container 30 is accomplished by positioning the tray 32 over the waste water container 30 and applying a light-to-moderate vertical downward force on the rim 108 of the upper tray 32. This force will then transfer itself into the clips 62. Due to flexure allowed by the clips 62 and the complementary inclination of face 56 of ridge 66 and the roundness of bottom wall 76 of nub 64, nub 64 will bend outward in direction 78 and slide past ridge 66 in a downward direction. Thus, upper tray 32 will snap onto waste water container 30. At this point, the upper tray 32 is clipped securely to the waste water container 30. Exemplary dimensions for waste water container 30 and sink upper tray 32 are shown in TABLES 1 and 2. These dimensions provide a sink 20 that is light-weight and compact. However, it is contemplated that the disclosure is also applicable to structures of other sizes and shapes.

TABLE 1

Exemplary dimensions for waste water container 30

| Dimension | US Imperial | Metric |
|---|---|---|
| Width | 10" | 25.4 cm |
| Depth | 5" | 12.7 cm |
| Height | 7" | 17.78 cm |
| Height below upper tray 32 | 3" | 7.62 cm |
| Volume of contained water = $0.5\pi * 0.5\ w^2 * h$ | 65.3 fl oz | 1.93 L |

TABLE 2

Exemplary dimensions for sink upper tray 32

| Dimension | US Imperial | Metric |
|---|---|---|
| Width | 9.875" | 25.08 cm |
| Depth | 4.875" | 12.38 cm |
| Height | 4" | 10.16 m |

Figure 10:
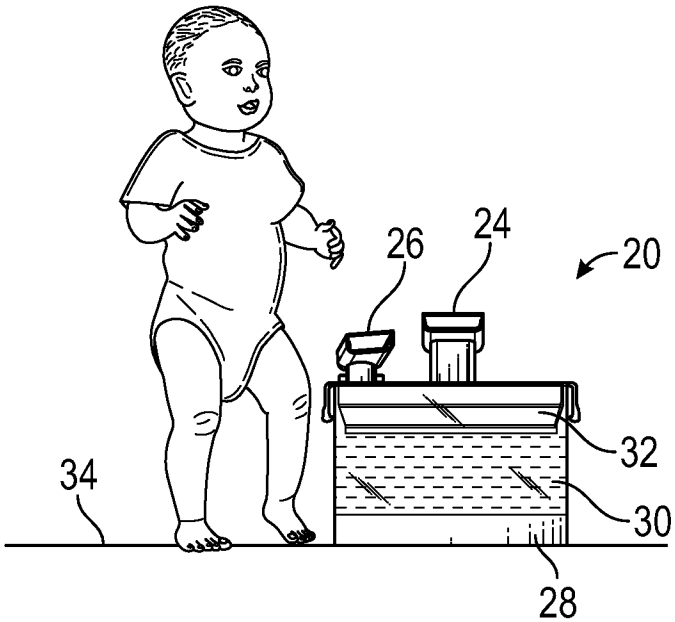
FIG. 10 is a front elevation view of an exemplary sink placed on a floor surface, for use by a small child.

FIG. 10 is an elevation view of an exemplary sink 20 placed on a floor surface 34, for use by a small child. FIG. 11 is an elevation view of an exemplary sink 20 placed on an optional leg assembly **22*b* to raise the sink above a floor surface 34, for use by a taller child. Children grow about 4-5 inches in the second year of life and about 3-4 inches in the third year. While not specifically illustrated, it is contemplated that sink 20** can be placed on any stable surface of suitable height for a particular child and location, such as a bench, for example.

As shown in FIGS. 1, 3 and 4, in one embodiment of leg assembly 22*a*, legs 50 splay outward toward ground surface 34, thereby offering a stable support for sink 20 that is sturdy and reliable. As shown in FIG. 4, the legs are configured to extend from corners of the sink 20, so that no leg is in the child's way at the front of the sink 20. As shown in FIG. 11, where longer legs 50 are used, leg assembly 22*b* may include two legs 50 attached by a cross brace 52. In an exemplary embodiment, the brace 52 retains the legs 50 in a splayed configuration that is wider at the bottom than at the top, for added stability. In an exemplary embodiment, the top of each leg 50 slides into a circular recess in the bottom of base 28.

In one embodiment, multiple sets of stackable leg assemblies 22 are provided. Each set raises the total height of the sink base 28 from the floor 34 by 4". At the base of each leg 50 is a thickened but hollowed-out segment 1.5" in length. The top of any other leg 50 can be inserted into this segment, thus allowing for additional height gains by the use of multiple legs vertically stacked and attached to each other. In other embodiments, height adjustability can be provided by telescoping features. In yet other embodiments, leg assemblies of different heights can be provided as accessory features.

TABLE 3

Exemplary dimensions for leg assembly 22

| Dimension | US Imperial | Metric |
|---|---|---|
| Diameter | 1.5" | 3.81 cm |
| Height | 5.5" | 13.97 cm |
| Insertion Depth | 1.5" | 3.81 cm |
| Rake (angle from front) | 5° | |
| Splay (angle from side) | 5° | |

As shown in FIG. 9, in an exemplary embodiment, sink base 28 includes container platform 54, fresh water tank 38 and electronics and soap housing 36. Waste water container 30 fits onto container platform 54 and in turn holds upper tray 32. Fresh water tank 38 holds water to be dispensed during washing. As shown in FIG. 4, electronics and soap housing 36 contains soap container 88, battery assembly 90, microcontroller 92, sensor 94 for water dispensing, sensor 96 for soap dispensing, water pump 98, soap pump 100, and transistors 102, among other electronic items and internal components, such as plumbing tubes and mechanisms. In an exemplary embodiment, base 28 also allows for the attachment of leg assemblies 22 via four equally spaced circular indentations, into which legs 50 may be attached.

As shown in FIGS. 3 and 5, viewed from the side, base 28 resembles an "L" shape. From this perspective, container platform 54 of the horizontal portion of the "L" shape is designed to fit snugly to and hold the waste water container 30 and its associated upper tray 32. As shown in FIG. 9, in an exemplary embodiment, the perimeter edge 46 of the container platform 54 has a vertically-extruded lip or ridge to help facilitate the easy placement and retention of the waste water container 30. The lip's shape corresponds to the stepped shape of the bottom perimeter edge 44 of waste water container 30 to help ensure a snug fit and a near-unbroken smooth outer surface between the sink base 28 and the waste water container 30.

In an exemplary embodiment, the vertical portion of the base 28 houses the fresh water tank 38 and the electronics and soap housing 36. In an exemplary embodiment, fresh water tank 38, accessible when water plug 42 is removed, has a capacity of approximately 1.15 liters of fresh water. Water tank 38 may optionally have a fill line positioned to mark 1 liter of stored fresh water. In an exemplary embodiment, a liquid soap container 88, accessible when soap plug 40 is removed, has a capacity of approximately 350 milliliters of liquid soap. Base 28 can include optional features such as a toothbrush pocket or clip-in towel holder, for example.

In an exemplary embodiment, fresh water from fresh water tank 38 is dispensed through motion-activated faucet 24, and soap from the soap compartment 88 is dispensed from motion-activated soap dispenser 26. In an exemplary embodiment, water faucet 24 is an automatic, touch-free component with a motion/object sensor 94 for determining when to dispense water using an electric water pump 98 connected to fresh water tank 38. When triggered by the motion/object sensor 94, the electric water pump 98 pushes water from tank 38 through an interior pathway leading up and forward through the nozzle of faucet 24, to be dispensed above the user's hands.

In an exemplary embodiment, both the water faucet 24 and liquid soap dispenser 26 contain motion/object sensors 94, 96 that utilize light reflectivity-sensing technology in the form of narrow field of view digital distance sensors, detecting the presence of nearby objects in their field of view. Each motion/object sensor unit is built around a digital distance sensor that detects the presence of an object within a distance of a few inches (typically between 0.2" and 4") from the sensor. The field of view of the digital distance sensor is narrow, extending approximately 5 to 10 degrees off of the primary axis of the sensor's line of sight. The faucet and soap dispenser each have one digital distance sensor. A suitable distance sensor is commercially available from Sharp, Inc. under model GP2Y0D810Z0F.

The digital distance sensors have electrical connections to a microcontroller 92 for applying specific, discrete voltage levels appropriate to whether motion, or an object blocking their field of view, is detected. A single programmable microcontroller 92 is used to receive signals from the object sensors 94, 96, determine the appropriate action required (enable or disable the water pump 98 and/or soap pump 100), and execute the action within a discrete time interval, based on the logic programmed into the microcontroller 92. This controller 92 is connected to two digital distance sensors 94, 96 and two transistors. A suitable microcontroller 92 is commercially available from MicroChip Technology Inc., under model ATtiny202.

The microcontroller 92 has electrical connections to the control pins of a set of transistors 102, through which, based on its programmed logic, it applies appropriate voltage levels to the transistors 102. Each of the two transistors 102, in addition to a connection with the microcontroller 92, also contains a connection to the battery assembly 90 and a connection to its respective electric pump 98, 100. Based on an appropriate voltage level received on its control pin, the transistor will either will allow or prevent electrical current to flow from the battery assembly 90 to the electric pump 98, 100, thus switching the pump on and off. Metal-Oxide-Semiconductor Field Effect Transistors 102 (MOSFETs) are used to switch on and off the electrical pumps 98, 100, based on a signal received from a microcontroller 92. Each electric pump 98, 100 is connected to one transistor 102. A suitable MOSFET is commercially available from Infineon Technologies under model IRLB8721PBF.

A removable cover (not shown) in housing 36 provides user access to install or replace the batteries that provide electrical power. In an exemplary battery assembly 90, six (6) AA batteries are used, each of a nominal 1.5 VDC (volts of direct current). The batteries are arranged in two parallel-connected sets of three-battery series, supplying a nominal 4.5 VDC to all electrical components of the sink 20. The battery assembly 90 is connected to all of the other electronic and electromechanical components. A suitable battery assembly 90 is commercially available from Pololu Corporation, under model number 142. A quantity of two such battery assemblies is used to contain the six AA batteries, with three batteries allocated to each assembly. This allows each assembly to provide a nominal 4.5 VDC from the three batteries wired as a series, and with both assemblies wired in parallel, double the total amperage and thus wattage is made available for a longer-running operating lifetime before the batteries are drained.

The electronics utilized in the operation of the motion/object sensors and water pumps are designed to operate on a supply voltage range of 3.3 VDC to 5 VDC, allowing for the use of rechargeable NiCD and NiMH AA batteries delivering a nominal 1.2 VDC each, and single-use Alkaline or Carbon Zinc batteries delivering a nominal voltage of 1.5 VDC each. In an exemplary embodiment, the minimum required voltage is 3.3 VDC, and the never-exceed voltage is 6 VDC.

TABLE 4

Typical expected current utilization for various scenarios:

| Scenario | Maximum Current Draw (at 4.5 VDC) |
|---|---|
| Quiescent state, no motion detected | 20 mA |
| Water pump running | 200 mA |
| Soap pump running | 250 mA |
| All electrical devices running ("worst-case" scenario) | 450 mA |

The removable battery cover features a gasket seal to prevent water entry into the battery compartment. A "master" On/Off switch is located inside the battery compartment, providing a single-source control point over the electrical connection between the power source (battery assembly 90) and power-consuming devices (controller 92, motion/object sensors 94, 96, water pump 98, soap pump 100, and transistors 102, for example).

Electric pumps 98, 100 are used to deliver water and soap from their respective containers 38, 88 through their respective dispensers 24, 26. The faucet 24 and soap dispenser 26 each have one electric pump 98, 100. A suitable electric pump is commercially available from Shenzhen Beanfeng Electronic Technology Co., Ltd. under model JT-DC3L-4.5. Detection of an object sends a voltage signal from the distance sensor 94, 96, triggering the electric pump 98, 100 that is in the same circuit as the distance sensor 94, 96.

In the case of the pump 98 attached to the water faucet 24, the water pump 98 will continue pumping water through the faucet spout 24 for as long as an object is detected by sensor 94, plus an additional time duration of approximately two seconds beyond the moment when an object was last detected, up to a maximum of fifteen seconds. After the faucet 24 ceases dispensing water, a "cool-down" period is in effect, during which the faucet 24 will not dispense water for up to ten seconds. This allows for an uninterrupted stream flowing of water in situations where a user's hands may temporarily leave the sensor's 94 field of view but not necessarily out of the stream of flowing water, only to return a fraction of a second later.

In an exemplary embodiment, the liquid soap dispenser 26 is an automatic, touch-free component with a motion/object sensor 96 for determining when to dispense soap and an electric pump 100 to facilitate the dispensation of the liquid soap. When triggered by the motion/object sensor 96, the electric pump 100 pushes liquid soap through an interior pathway leading up and forward through the soap dispenser's nozzle 26, to be dispensed above the user's hands.

In contrast to the mode of water dispensation, in an exemplary embodiment, for the pump 100 attached to the liquid soap dispenser 26, the soap pump 100 will run for a fraction of a second, when an object is detected by the distance sensor 96, to trigger the release of a small quantity of liquid soap, approximately $1/8^{th}$ of a fluid ounce. A "cool-down" period of three seconds will then take place, with no liquid soap dispensed during that time.

TABLE 5

Exemplary dimensions for sink base 28 and housing 36

| Dimension | US Imperial | Metric |
|---|---|---|
| Width | 10" | 25.4 cm |
| Height from bottom to lower floor surface | 2" | 5.08 cm |
| Total Height | 9.5" | 24.13 cm |
| Depth (vertical wall to front) | 5" | 12.7 cm |
| Depth to faucet (back to front of faucet) | 7.5" | 19.05 cm |
| Total Depth (back to front) | 10" | 25.4 cm |
| Fresh Water Tank Volume | 38.9 fl oz | 1.15 L |
| Liquid Soap Container Volume | 11.8 fl oz | 350 |

Exemplary, non-limiting embodiments of a sink apparatus are described. For example, an apparatus 20 includes a base 28; a reservoir 38, 88 connected to the base 28 and configured to hold a fluid; a first vessel 30 having a first volume and configured to be removably connected to the base 28; a connection 24, 26, configured to deliver the fluid from the reservoir 38, 88 to at least the first vessel 30; and a second vessel 32. The second vessel 32 is configured to be disposed at least partially within the first vessel 30; configured to be removably secured to the first vessel 30; and includes an aperture 48 that allows for fluid communication between the second vessel 32 and the first vessel 30. The second vessel 32 has a second volume that is less than the first volume.

In an exemplary embodiment, the apparatus 20 includes a clip 62 that is configured to secure the second vessel 32 to the first vessel 30. In an exemplary embodiment, the clip 62 is disposed proximate a rim 108 of the second vessel 32. In an exemplary embodiment, the clip 62 extends outward and downward over a rim 104 of the first vessel 30. In an exemplary embodiment, the first vessel 30 includes a ridge 66 configured to engage with the clip 62. In an exemplary embodiment, the clip 62 includes a nub 64 configured to contact the ridge 66. In an exemplary embodiment, the ridge 66 has a substantially trapezoidal cross-sectional shape. In an exemplary embodiment, the ridge 66 includes a first inclined face 56. In an exemplary embodiment, the ridge 66 includes an outer face 68 connected to the first inclined face 56. In an exemplary embodiment, the ridge 66 comprises a horizontal bottom wall 72 connected to the outer face 68. In an exemplary embodiment, the clip 62 includes a nub 64 configured to contact the ridge 66, the nub 64 having a second inclined face 70 that substantially matches an inclination angle of the outer face 68. In an exemplary embodiment, the nub 64 comprises a horizontal top wall 74 connected to the second inclined face 70.

In an exemplary embodiment, the connection 24, 26 operably communicates with a fluid pump 98, 100. In an exemplary embodiment, an object sensor 94, 96 is operably connected to the fluid pump 98, 100. In an exemplary embodiment, a controller 92 is operably connected to the object sensor 94, 96. In an exemplary embodiment, a battery 90 is operably connected to the controller 92.

In an exemplary embodiment, a leg 50 is configured for connection to the base 28. In an exemplary embodiment, a third volume of the reservoir 38, 88 is less than the first volume. In an exemplary embodiment, the first vessel 30 has a semi-circular shape. In an exemplary embodiment, the first vessel 30 is visually transparent.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

The invention claimed is:

1. An apparatus including:

a base;

a reservoir connected to the base and configured to hold a fluid;

a first vessel having a first volume and configured to be removably connected to the base;

a connection configured to deliver the fluid from the reservoir to at least the first vessel;

a second vessel:

configured to be disposed at least partially within the first vessel;

configured to be removably secured to the first vessel;

including an aperture that allows for fluid communication between the second vessel and the first vessel; and having a second volume that is less than the first volume; and a clip that is configured to secure the second vessel to the first vessel.

2. The apparatus of claim 1 wherein the clip is disposed proximate a rim of the second vessel.

3. The apparatus of claim 1 wherein the clip extends outward and downward over a rim of the first vessel.

4. The apparatus of claim 1 wherein the first vessel includes a ridge configured to engage with the clip.

5. The apparatus of claim 4 wherein the clip includes a nub configured to contact the ridge.

6. The apparatus of claim 4 wherein the ridge has a substantially trapezoidal cross-sectional shape.

7. The apparatus of claim 4 wherein the ridge includes a first inclined face.

8. The apparatus of claim 7 wherein the ridge includes an outer face connected to the first inclined face.

9. The apparatus of claim 8 wherein the ridge comprises a horizontal bottom wall connected to the outer face.

10. The apparatus of claim 8 wherein the clip includes a nub configured to contact the ridge, the nub having a second inclined face that substantially matches an inclination angle of the outer face.

11. The apparatus of claim 10 wherein the nub comprises a horizontal top wall connected to the second inclined face.

12. The apparatus of claim 1 wherein the connection operably communicates with a fluid pump.

13. The apparatus of claim 12 comprising an object sensor operably connected to the fluid pump.

14. The apparatus of claim 13 comprising a controller operably connected to the object sensor.

15. The apparatus of claim 14 comprising a battery operably connected to the controller.

16. The apparatus of claim 1 comprising a leg configured for connection to the base.

17. The apparatus of claim 1 wherein a third volume of the reservoir is less than the first volume.

18. An apparatus including:

a base;

a reservoir connected to the base and configured to hold a fluid;

a first vessel having a first volume and configured to be removably connected to the base, wherein the first vessel has a semi-circular shape;

a connection configured to deliver the fluid from the reservoir to at least the first vessel; and a second vessel;

configured to be disposed at least partially within the first vessel;

configured to be removably secured to the first vessel;

including an aperture that allows for fluid communication between the second vessel and the first vessel; and having a second volume that is less than the first volume.

19. The apparatus of claim 1 wherein the first vessel is visually transparent.

20. The apparatus of claim 18 wherein the second vessel has a half-cylinder shape.

* * * * *